US008104600B2

(12) United States Patent
Sanchez Pineiro

(10) Patent No.: US 8,104,600 B2
(45) Date of Patent: Jan. 31, 2012

(54) ESCALATOR

(76) Inventor: Jesus Sanchez Pineiro, Granollers (ES)

( * ) Notice: Subject to any disclaimer, the term of this patent is extended or adjusted under 35 U.S.C. 154(b) by 14 days.

(21) Appl. No.: 12/812,920

(22) PCT Filed: Jan. 7, 2009

(86) PCT No.: PCT/ES2009/000004

§ 371 (c)(1),
(2), (4) Date: Jul. 14, 2010

(87) PCT Pub. No.: WO2009/090282

PCT Pub. Date: Jul. 23, 2009

(65) Prior Publication Data

US 2010/0326790 A1 Dec. 30, 2010

(30) Foreign Application Priority Data

Jan. 14, 2008 (ES) ..... 200800138

(51) Int. Cl.
*B66B 23/12* (2006.01)

(52) U.S. Cl. ..... 198/333

(58) Field of Classification Search ..... 198/333, 198/321, 324

See application file for complete search history.

(56) References Cited

U.S. PATENT DOCUMENTS

| | | | | |
|---|---|---|---|---|
| 4,411,352 | A | 10/1983 | Kettle | |
| 4,681,207 | A | 7/1987 | Goto et al. | |
| 5,332,077 | A * | 7/1994 | Ogimura | 198/333 |
| 5,353,907 | A * | 10/1994 | Ogimura et al. | 198/333 |
| 5,472,075 | A * | 12/1995 | Yamashita et al. | 198/324 |
| 5,542,521 | A * | 8/1996 | Meyer et al. | 198/324 |
| 5,992,605 | A * | 11/1999 | Haruta | 198/333 |

FOREIGN PATENT DOCUMENTS

JP 2005178923 A 7/2005

OTHER PUBLICATIONS

International Search Report for Application No. PCT/ES 2009/000004 dated Apr. 24, 2009.

* cited by examiner

*Primary Examiner* — James R Bidwell
(74) *Attorney, Agent, or Firm* — Honigman Miller Schwartz and Cohn LLP

(57) ABSTRACT

Escalator with a series of steps connected to at least one drive chain, driven by a motor mechanism, travelling via an advanced track and a return track placed alongside, there being transition zones between two levels, the tracks respectively comprising a main set of guides and at least one set of additional guides for moving a movable step, via the bearing thereof, parallel to a non-movable step, so that they are positioned at the same height, creating a widened continuous platform which can accommodate a person with reduced mobility.

19 Claims, 9 Drawing Sheets

ESCALATOR

TECHNICAL FIELD

The present invention refers to an escalator comprising a plurality of movable steps along an advance track adapted to be inclined between two heights or levels to be covered.

BACKGROUND

At present the use of escalators and other transport means between two zones, preferably at different heights, allow people or goods to be transported continuously, is common.

One example are escalators arranged between two heights (e.g., between two floors of a building) since they are efficient and comfortable, particularly where there is an abundant and constant circulation of people, for example in railway stations, airports, shopping centres or public buildings. Other means for transporting people, such as lifts, service lifts and elevators have a high transfer capacity for each journey, which can be at a great height covering several floors, but unlike escalators they do not allow for continuous transit.

In an implementation, when escalators are utilized to transport people, they may be configured as a series of steps arranged on a drive chain, moved by a motor geared to said chain and controlled by a control unit. The steps and the drive chain travel via at least one advance track that configures the travel direction, returning via a return track, which is commonly hidden, with intermediate transition zones of said series of steps in between. At least the advance track is made up of a set of lateral guides in which the steps are moved by means of bearings on both sides of the step. The steps may be rigid with a tread and at least one riser.

In such an example, the user may position himself/herself at the entrance of the advance track until he/she observes a step exiting from the chain that is moving continuously, he/she steps onto it and waits for the step to move him/her toward the other end of the advance track, either upwards or downwards. A problem lies in the fact that the steps have a tread with a specific length which is limited by the height of the step riser or height difference between two consecutive steps which must be small enough to allow a person to move along the escalator feasibly in the event that the latter stops.

Typically, this length is about 45 to 65 centimeters, which prevents people with reduced mobility, such as people in wheelchairs, walking frame users, people with crutches or baby pushchairs from using the escalator.

In order to overcome the limitations, alternative transport means have been proposed. For example, the use of a lift, which is limited to vertical elevation, is common while the use of a ramp is not possible according to current regulations for gradients greater than 10% in the case of greater possible inclination. Platforms or stair lifts do not present these inclination limitations, therefore they can cover those intermediate inclinations with respect to the previous solutions, but they tend to be slow and, often require the assistance of other people or the use of an activating key with the inherent setbacks associated therewith.

Alternative escalators have been developed to overcome said difficulties by means of the vertical movement of at least one of the steps in order to position it at the same height as that of a conventional previous or subsequent step so that the sum of the length of both steps sets up a coplanar platform of greater length.

U.S. Pat. No. 5,353,907 for a "Dual Purpose escalator for wheelchair" describes a dual-purpose escalator comprising a plurality of specialized steps for loading a wheelchair. The escalator comprises an apparatus that activates said specialized steps so that in a wheelchair loading operation, an assembly of three steps alters its configuration. A first specialized step, subsequent to a central step, comprises a gear and a multiple scissor-type mechanism that allows the tread to be elevated to the correct height in order to be coplanar with the previous step. At the same time, a specialized step, previous to the central step, comprises a mechanism that allows it to fold down at a suitable angle to expand the length of the previously assembled platform. This escalator allows the mentioned formation of an expanded platform but of incomplete length with respect to the three steps involved. In addition, the specialized steps are heavier due to the mechanisms that they incorporate, thus such can cause an imbalance of the drive chain. Also, the engagement of the movement mechanisms of the specialized steps with the mechanism that allows it to be activated at the beginning of the advance track can fail.

Another problem that conventional escalators present is that they do not permit simultaneous transport upwards and downwards. This is mainly due to the fact that the return track of the chain of steps is carried out under the advance track, in the reverse direction.

U.S. Pat. No. 4,411,352 for a "Racetrack escalator" describes an escalator in which the return track is arranged parallel to a lateral of the advance track, thus both are useful, namely one track for going up and the other track for going down. On this escalator the transition zones arranged between the ends of the tracks are configured by a horizontal turn of 180 degrees under a platform that allows entrance or exit. The steps have an approximately parallelepiped shape and they comprise sets of bearings allowing their movement along guides, while between each two steps is a linkage element with two mounting holes that are respectively arranged on two existing vertical pivots on one of the laterals of said steps. The linkage element permits one step to move vertically with respect to the adjacent step, both upwards and downwards, so it can be used both on an ascending and descending track within the same movement direction and to align the turn horizontally. However, this escalator does not have means to allow the transport of wheelchairs or people with reduced mobility using the configuration of an elevating platform with two or more adjacent steps. Furthermore, the space required by this escalator is very wide due to the sweeping stroke of the transition zones and in addition the linkage among steps can be weak, thus the total length of the step drive chain must be especially short in order to reduce stresses.

SUMMARY

In an implementation, the escalator presents some technical particularities that are intended to eliminate the architectonic barriers that people with reduced mobility meet in their daily life.

The described escalator allows the typical gradients of escalators to be overcome and therefore also the inclinations usually found in areas where people circulate in buildings and other places. The difference with respect to the present escalator is two-fold, namely the possibility of use both in a conventional way as well as by people with reduced mobility, such as people in wheelchairs, people with baby pushchairs, ambulance stretchers, people with walking frames or in general, any person having difficulties accessing a conventional escalator. The second feature of this escalator is the fact that it turns, thus permitting the same escalator to be used both for going up and down. In this way, it is not necessary to install two escalators, thus saving energy and material and consequently reducing the cost of the economic investment.

This escalator provides the advance track constituted by at least one set of additional guides for moving the movable step on its bearings, parallel to a non-movable step so that they are positioned at the same height, creating a continuous platform which can accommodate a person with reduced mobility in a wheelchair, with a walking frame or a large package. In order to be able to arrange the movable step in the additional set of guides, provision has been made at the ends of the advance track, in correspondence with the entrance and exit zones to the escalator, for point changes that permit the positioning and/or return of the movable steps between the set of guides in the transition zones and the set of main guides and/or the set of additional guides in both the entrance and exit zones to the escalator. Thus in conventional conditions all the steps move on the main track via their set of guides, just as a conventional escalator. In the event that a widened platform is required for special use, by activating the suitable command, the movable step is introduced into the advance track on the additional set of guides, in such a way that now its movement on said track is carried out in a completely coplanar way with a non-movable adjacent step.

In order to facilitate the movement of the step bearings, provision has been made for said rear and front bearings to be arranged on one plane parallel to the inclined plane of the advance track, thus reducing the number of necessary guide couples both on the main set of guides as well as in the sets of additional guides, although it is also possible for the rear and front bearings of each step to be arranged in another way, such as one horizontal plane.

On each main set of guides and on each additional set of guides, the movement guide couples of the front and rear bearings on each side of the steps are arranged at different longitudinal vertical planes with respect to the advance direction. Thus, in an implementation of the step, the rear bearings are mounted with a track gauge smaller than the front bearings of the step, which facilitates the handling of the step along the circuit on which it circulates.

In an implementation, the advance track comprises an additional set of guides above the set of main guides and an additional set of guides below said main set of guides for the positioning of two movable steps on both sides of a non-movable step to create a widened platform with a depth three times that of a single step. Thus the widened transport platform is constituted by a step that can be moved upwards and towards one side, a non-movable or conventional step arranged in an intermediate position and a second step that can move downwards on the other side of the non-movable step. This set of three coplanar steps can accommodate, if desired, a pushchair, a wheelchair or a person with a walking frame, along its widened length. In the event that said widened platform were not desired, the three steps circulate in the conventional way thanks to the main set of guides of the advance track in order to function as a conventional escalator with the three steps arranged at different heights. Along the entire step chain it is possible to have one or more step assemblies for the configuration of one or more widened platforms, as desired, since it is possible to install said assemblies in a completely modular way.

In order to reduce the investment and energy consumption that the present escalator requires in comparison with a conventional escalator, provision has been made for the arrangement of a return track on one side of the advance track, thus simultaneously creating an accessible transport path in a direction opposite to the transport path of the main track.

For this, the transition zones between the advance track and the return track have sets of guides for the steps to turn in a fanned out position. These sets of guides comprise a guide couple of the rear bearings that are arranged at a level below the guide couple of the front bearings, making the steps incline backwards slightly. This inclination, which can become almost vertical but without hanging, allows the space taken up by each step to be reduced. The inclined steps take up a smaller space and it allows their geared arrangement, thus reducing the space necessary for the transition zone. These transition zones are placed under concealing platforms, which are arranged at floor level and create the entrance and exit zones to the advance and return tracks, both at the top and at the bottom of the escalator.

The links of the step drive chain are constituted by arms that are articulated to the shaft of the front bearings of the steps. Although a single drive will be represented to facilitate the simplicity of the invention, it is preferable that the steps are driven by two drive chains, one on each side, in order to balance the force distribution on the steps and the advance and return tracks.

These drive chains present links constituted by arms that are articulated to the shaft of the front bearings of the steps. Likewise, the drive chain comprises holding arms oscillating from the movable steps to the non-movable adjacent step, with which they create the widened platform. Thus the movable step is moved by the drive chain, whether it circulates along the main set of guides or along the sets of additional guides. These holding oscillating arms of the movable step are more specifically coupled by their ends to the shafts of the front bearings of both the movable and non-movable steps, thus easily providing for the controlled folding of said steps in the adequate zones.

In an implementation, when the return track is arranged on one side of the advance track to facilitate the double use of the escalator, provision has been made for the arms of the drive chains to be made up of two partial arms crossed and bound by means of a projecting appendix at the end of one partial arm with a "T" stop housed inside a longitudinal slot of the other part arm so they can be coupled together. This formation allows the drive chain, in an interior arrangement, to be able to carry out a variation of the distance among the couplings with the steps.

Thus it is possible for the fanned out movement of the steps in the transition zones to be carried out in a compacted way, with the steps being arranged closer on the inner side of the turn and the steps being arranged further away at the outer side of the turn, whilst maintaining adequate continuity. These partial arms have, on their opposite ends, vertical articulations for coupling to the bearing shafts of the steps. In addition, provision has been made in the transition zones for at least one inner positioning guide, with curved alignment, of the steps in the turn between the advance and return tracks. Likewise, it is also advantageous to provide an outer positioning guide, also of curved alignment, that allows for smoother positioning and prevents the steps from moving outside their path by means of positioning stops present on, at least, one lateral of the step, preferably at the projecting end of the shaft of the inner bearing.

This escalator is completed with platforms for concealing the transition zones at the entrance and exit of the advance and return tracks, where the entering and exit levels of the widened platforms are also established, giving the sensation that there are two independent escalators.

The usable return track mentioned comprises a main set of guides to move the steps in standard conditions, the guide couples pertaining to the circulation of the different bearings being out of phase, so that the treads of the steps continue in a horizontal position. On this main set of guides there is an additional set of guides that is intended for the circulation of the movable step that ascends for the creation of the widened platform. Also, below this set of main guides there is a second additional set of guides that is intended for the circulation of the movable step that descends for the creation of the widened platform. These sets of additional and main guides have duplicated guide couples as the axes of the previous part and subsequent part are staggered at different heights with respect to the advance direction. Thus the sets of guides of the steps in this return track comprise a guide couple for the front bearings of the steps and a guide couple for the rear bearings of the steps. Both guide couples are arranged at an adequate height to position the steps with the tread in a slightly horizontal plane. However, the distance between the bearings and the angle with respect to the vertical has been provided so as to allow for some of the guide couples of the front and/or rear bearings of the sets of additional guides and some of the guide couples of the previous and/or subsequent bearings of the mains set of guides to be common, the guide couples being reduced to four couples.

When the widened platform is created by the coplanar arrangement of the three steps that configure the modular assembly, there are gaps between said steps and the next steps, both the previous and the subsequent step, which are preferably covered. This situation is produced both on the advance track and on the return track when it is used. Therefore the steps involved have a folding riser that can be activated to completely cover said rise spaces between the height of the tread of one step and the height of the tread of an adjacent step that is notably vertically separated. The activation of this folding riser is automatic by means of lateral actuators. In addition, the folding of the riser allows a reduction in the volume of the step in the transition zone when this is inclined, thus compacting the fan formed.

The folding down risers of the steps involved are the front risers on the first step of the platform and in the following step adjacent to the platform on the return track, the rear risers being fixed.

For the escalator to function, the control unit may be associated with drive means at the ends of the tracks for the arrangement of the group of steps configuring the widened platform on one coplanar plane for the entrance and/or exit of a user ready to use one of the platforms.

Among other possibilities, these means can be either a remote control or a push-button, which makes it possible to indicate the request for the formation of the widened platform.

In order to indicate that said platform can be used at the entrance or exit, the control unit can have suitably placed acoustic and/or luminous warning signals. Once the assembly of steps configuring the widened platform reaches one of the two ends of the escalator, transport speed is reduced until stopping to facilitate the comfortable entrance or exit of the user.

Just as on a conventional escalator, provision has been made for transport tracks to have conventional handrails for users to hold while they are transported.

The escalator can be operated in reverse, which allows both the advance track and return track to be used for going up and down indistinctly.

These and other claimed characteristics can be seen with more detail in the figures and the preferred embodiment subsequently described.

DESCRIPTION OF THE DRAWINGS

In order to complement the description that is being carried out and with the purpose of facilitating the understanding of the characteristics of the invention, the present description is accompanied by a set of drawings wherein, by way of a non-limiting example, the following has been represented.

Like reference symbols in the various drawings indicate like elements.

DETAILED DESCRIPTION

Figure 1:
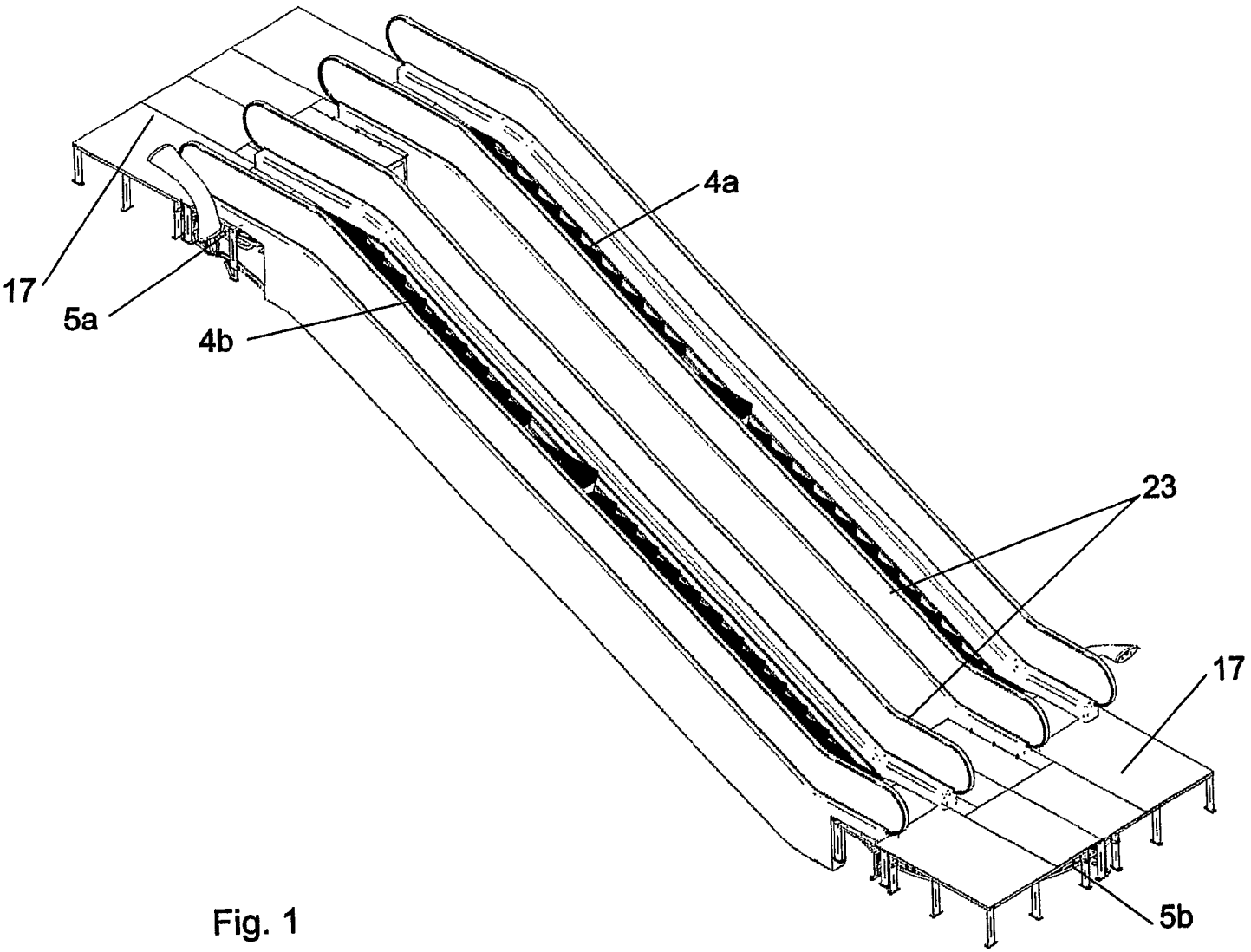
FIG. 1 shows a perspective view of an embodiment of the invention.
Figure 2:
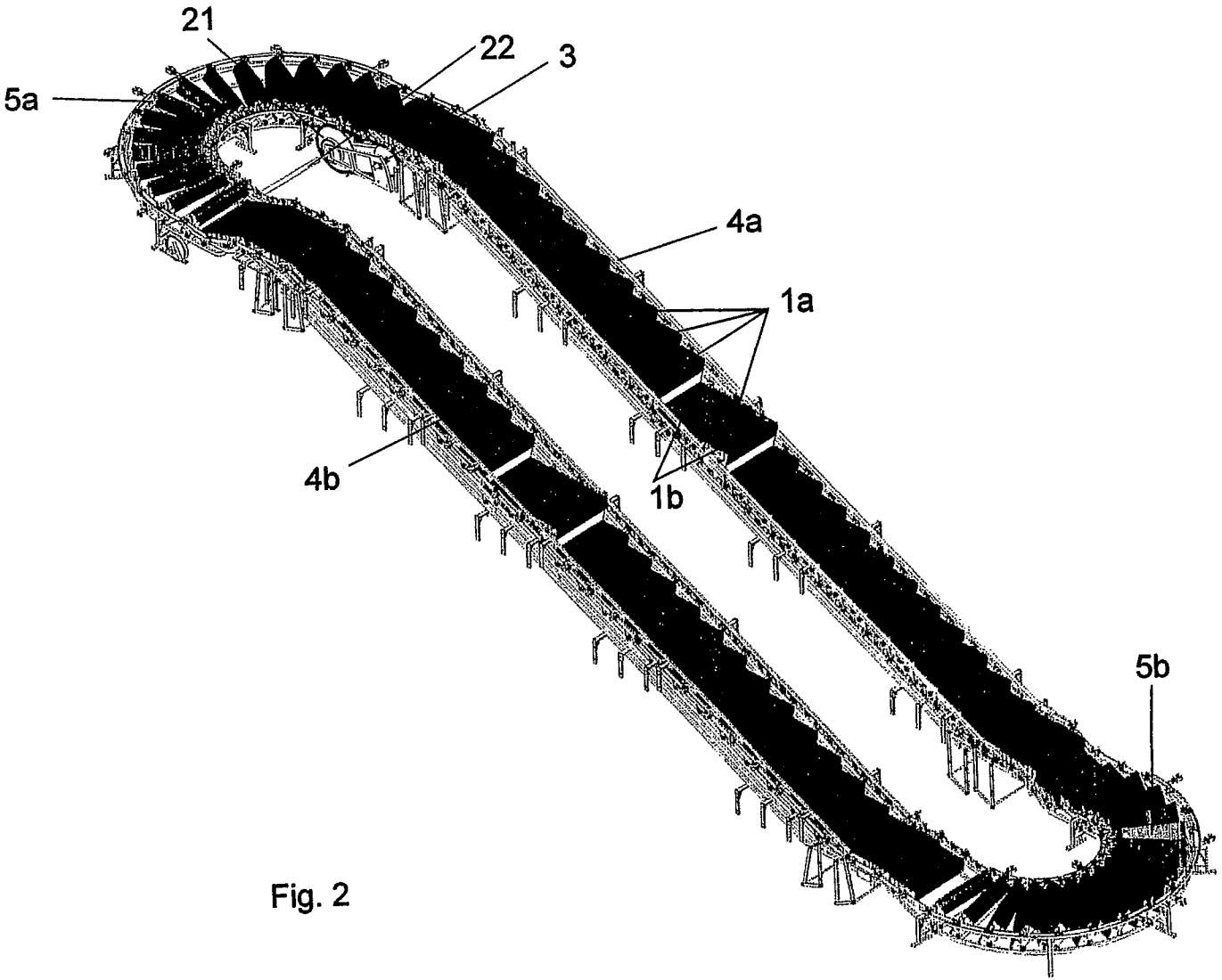
FIG. 2 shows one detail of the previous figure with the path of the series of steps along the advance and return tracks and the transition zones.
Figure 3:
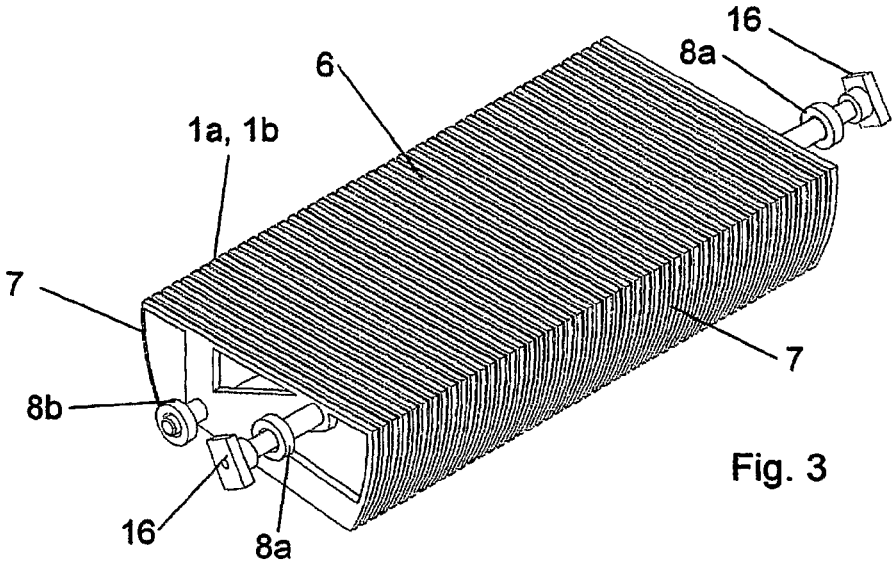
FIG. 3 shows a perspective view of one step.
Figure 4:
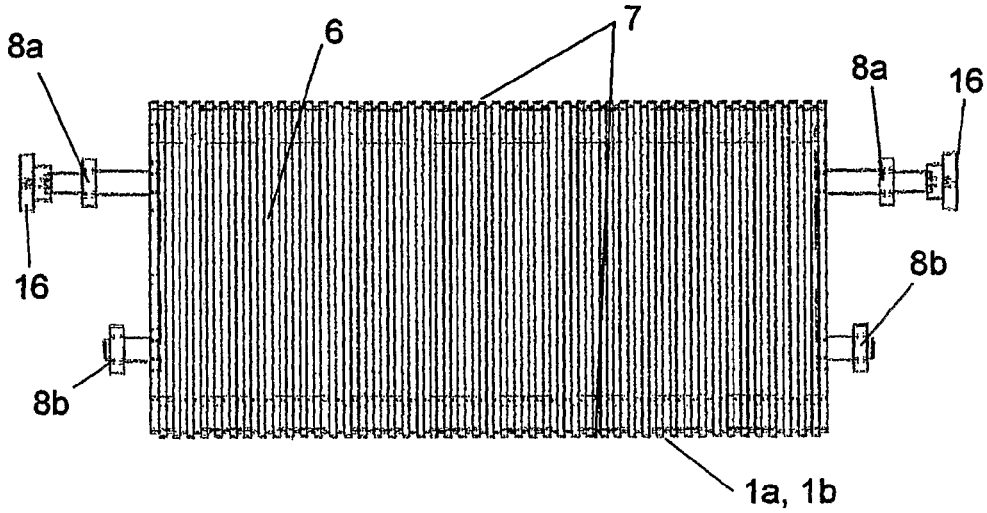
FIG. 4 shows a plan view of one step.
Figure 5:
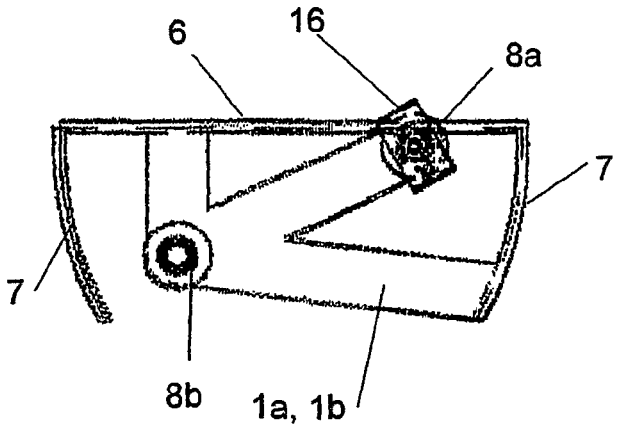
FIG. 5 shows a profile view of one step.
Figure 7:
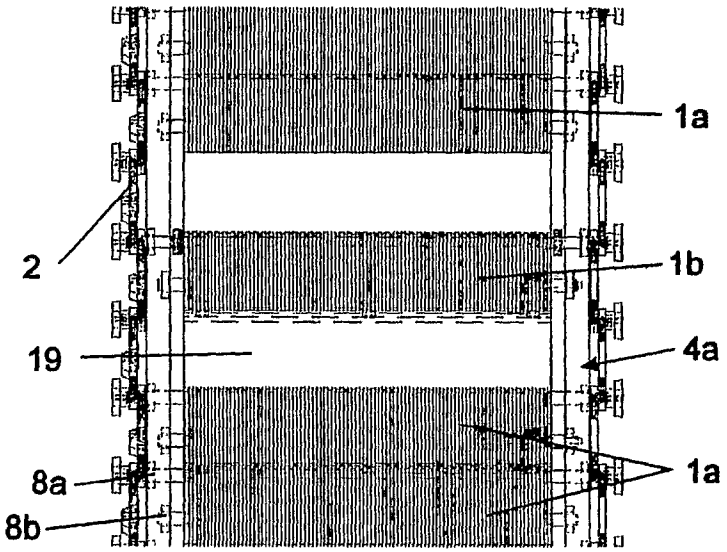
FIG. 7 shows an elevation view of a widened platform on the advance track.
Figure 6:
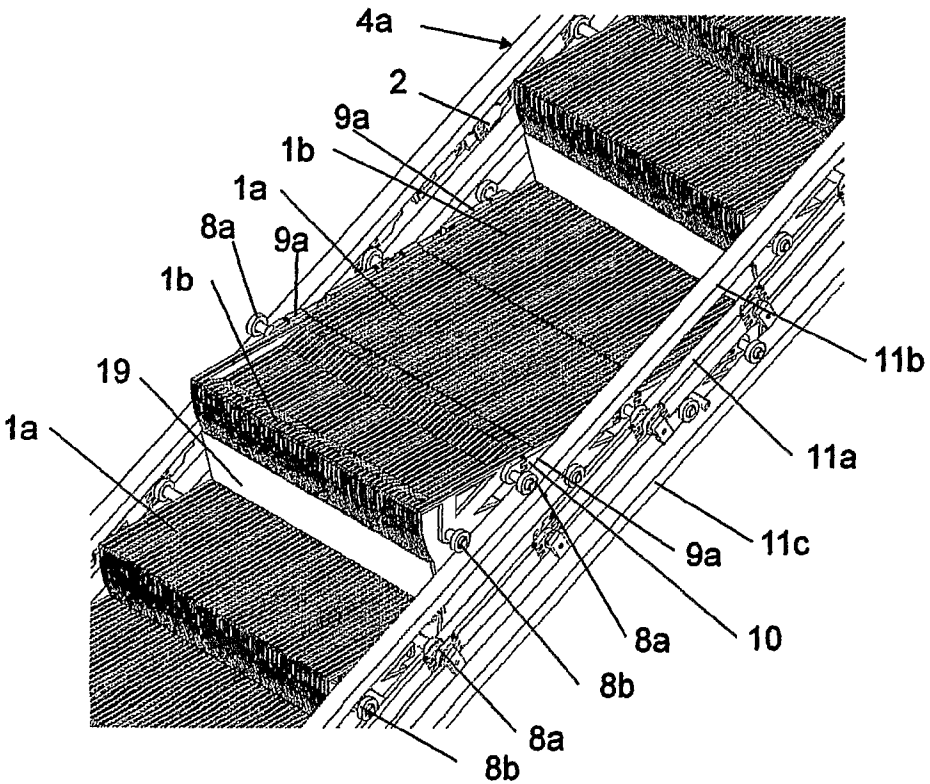
FIG. 6 shows a perspective view of a widened platform on the advance track.
Figure 9:
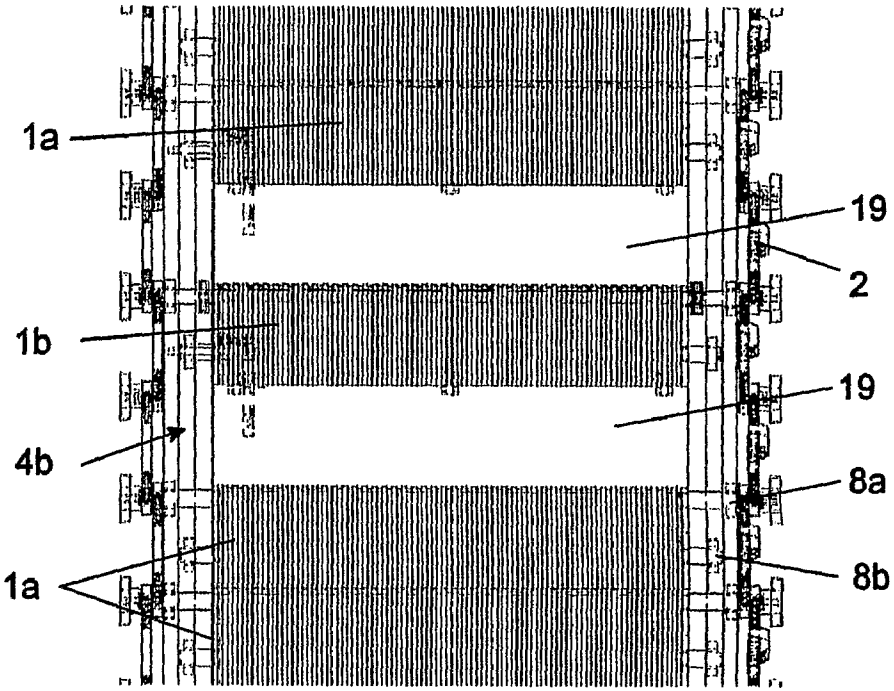
FIG. 9 shows an elevation view of a widened platform on the return track.
Figure 8:
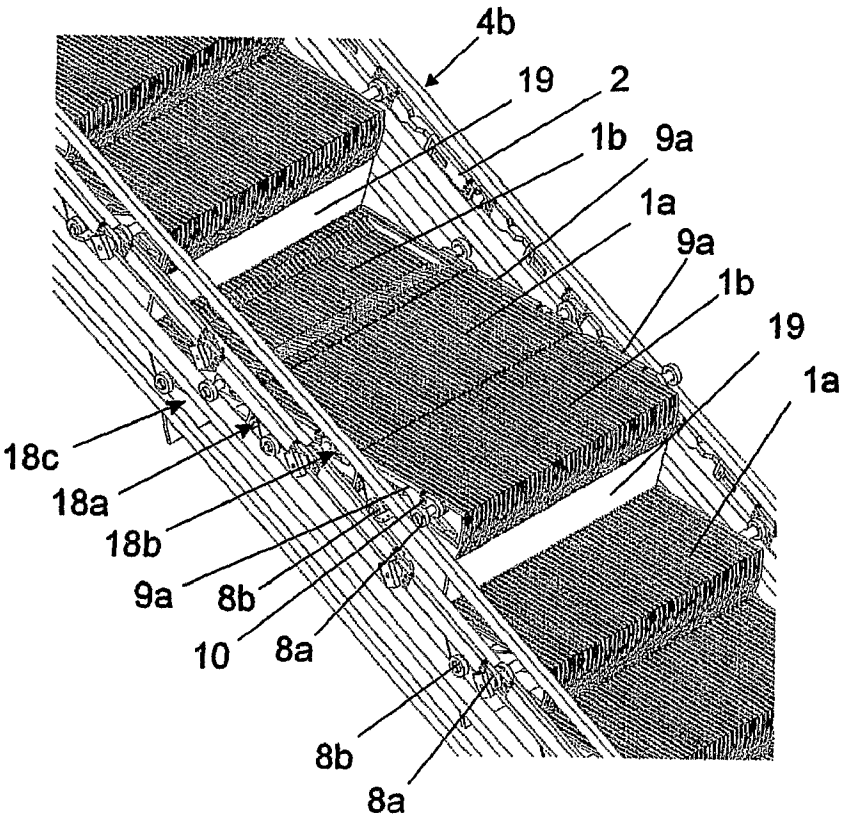
FIG. 8 shows a perspective view of a widened platform on the return track.
Figure 10:
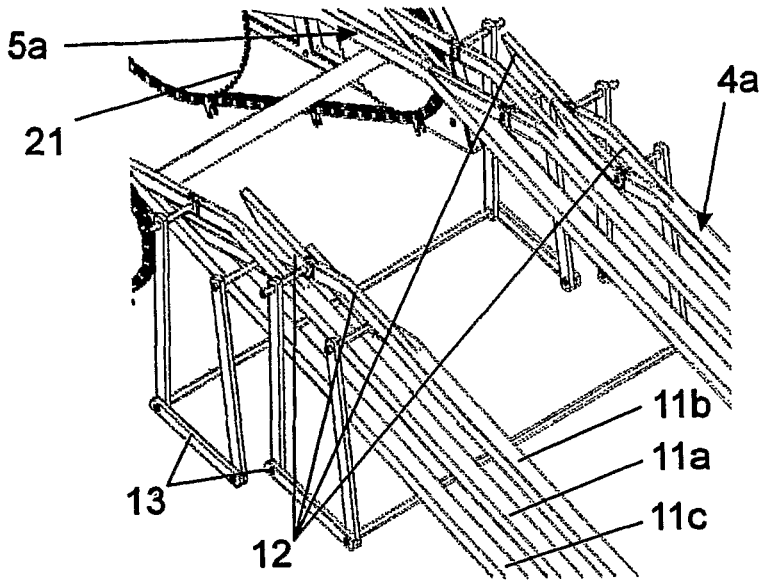
FIG. 10 shows a perspective view of one detail of the set of points at the top of the advance track.
Figure 11:
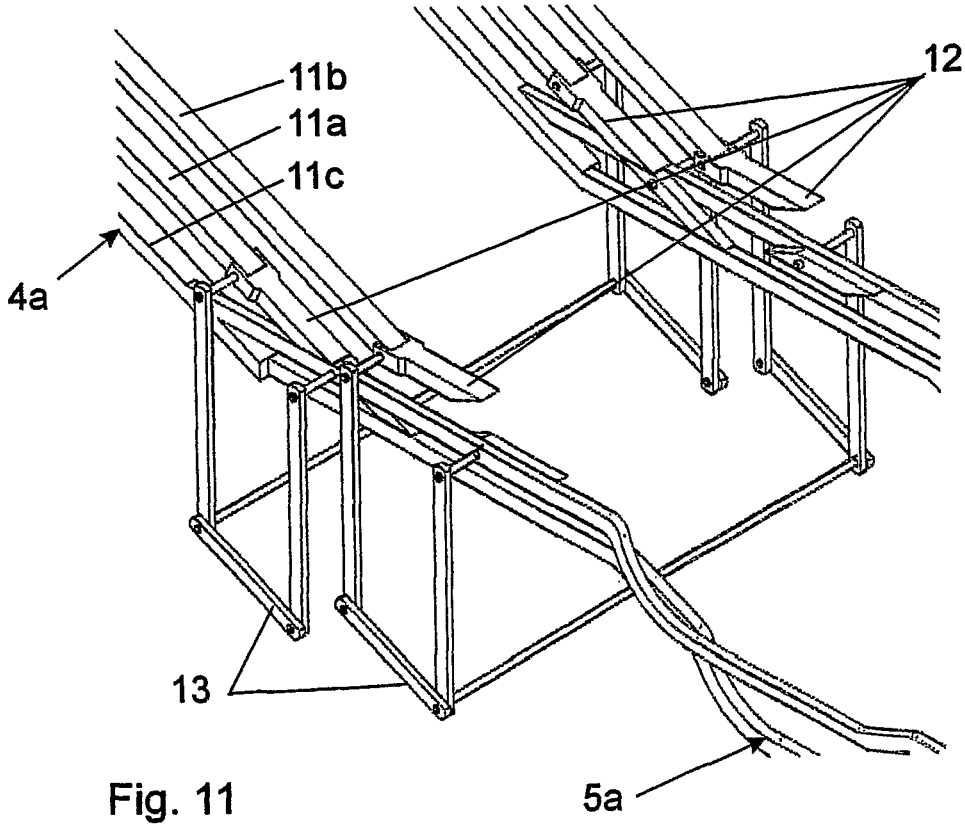
FIG. 11 shows a perspective view of one detail of the set of points at the bottom of the advance track.
Figure 12:
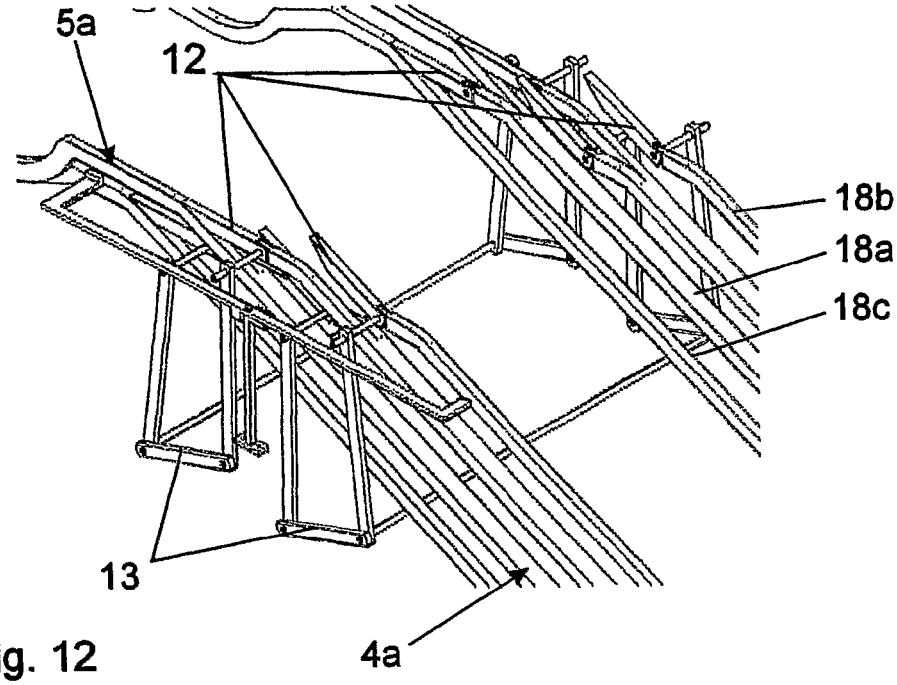
FIG. 12 shows a perspective view of one detail of the set of points at the top of the return track.
Figure 13:
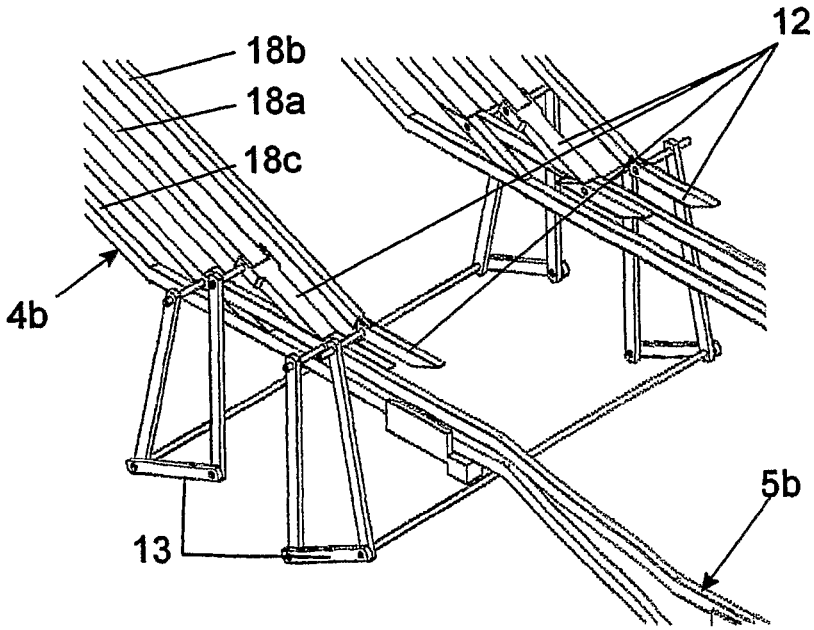
FIG. 13 shows a perspective view of one detail of the set of points at the bottom of the return track.
Figure 14:
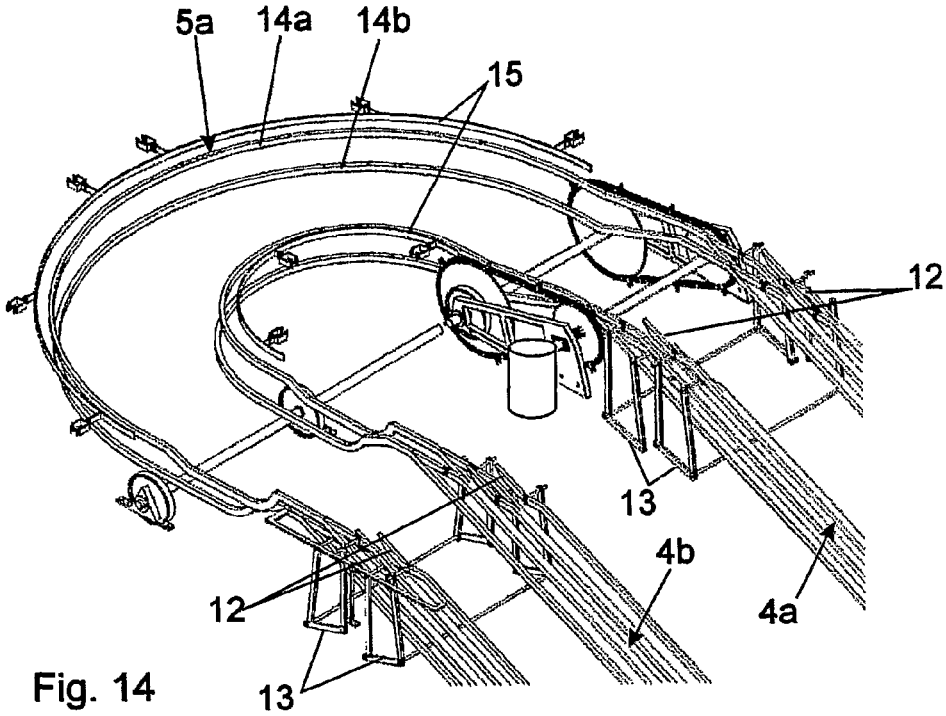
FIG. 14 shows a perspective view of one detail on the top transition zone, showing the bearing guide couples of the steps and the positioning guides during the turn.
Figure 15:
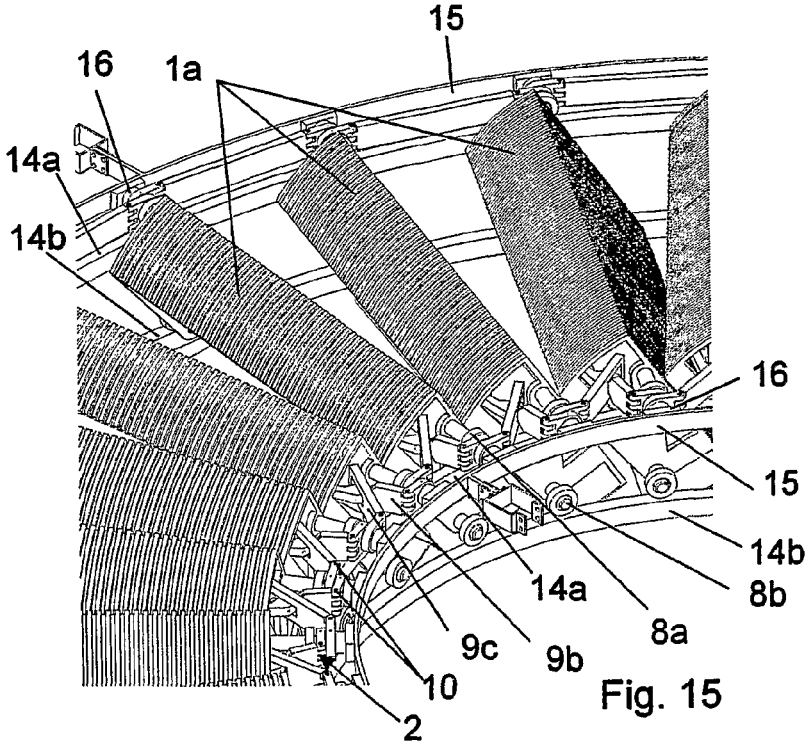
FIG. 15 shows a perspective view of one detail of the series of steps folded down in the transition zone.
Figure 16:
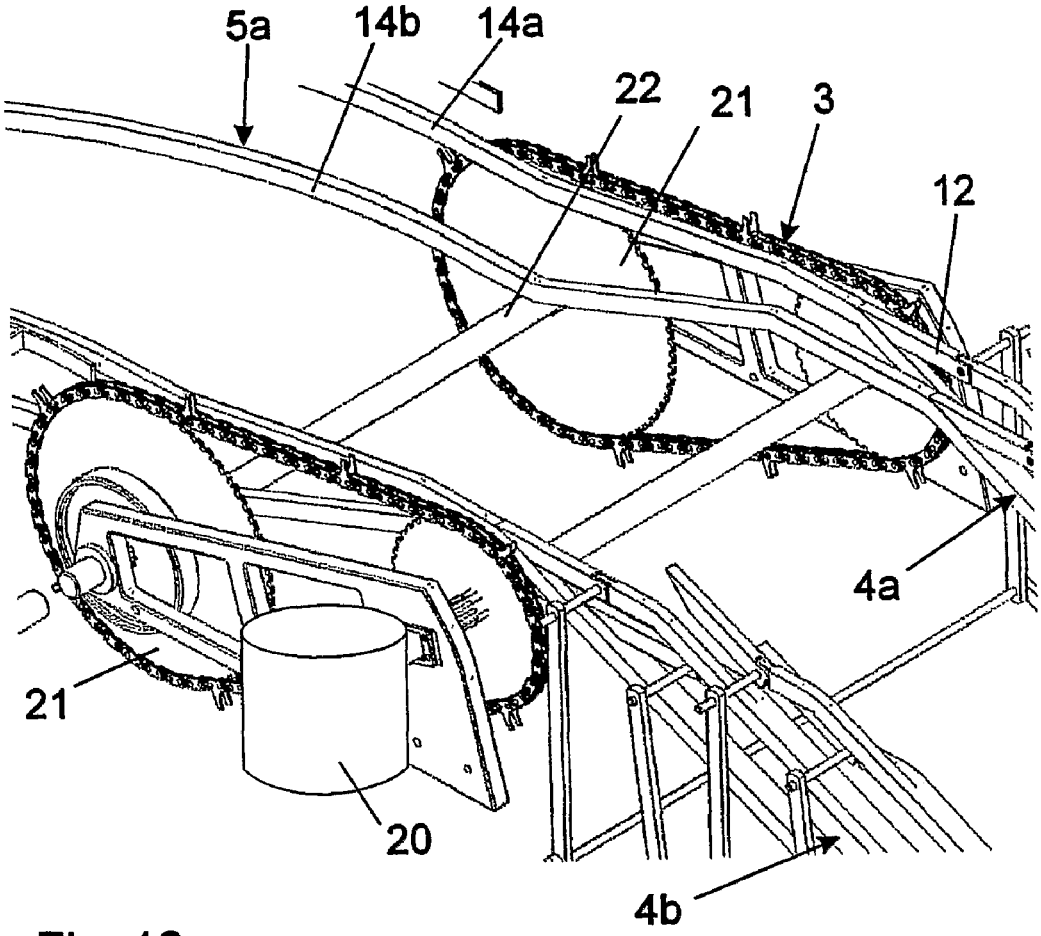
FIG. 16 shows a perspective view of one detail of the drive mechanism between the advance track and the top transition zone.

As can be seen in the referenced figures, the escalator comprises a plurality of steps (1*a*, 1*b*) associated to a couple of drive chains (2) driven by a motor mechanism (3) via an advance track (4*a*) and a return track (4*b*) placed alongside, both tracks (4*a*, 4*b*) being usable, and found between the ends of both tracks (4*a*, 4*b*) are horizontal fan-like transition zones (5*a*, 5*b*) of the steps (1*a*, 1*b*) for the continuous transport of users between two different levels via inclined paths.

In general, each step (1*a*, 1*b*) presents an approximately prismatic configuration with a tread (6) or upper metallic striated surface and a riser (7) prolonged downwards preferably with a curved shape at the front side and another riser (7) on the rear side. On both sides of the step (1*a*, 1*b*) there are front and rear bearings (8*a*, 8*b*), arranged according to a parallel circulation plane with respect to the advance track (4*a*) inclination, the rear and front bearings (8*a*, 8*b*) being situated on each side of the steps (1*a*, 1*b*) on different longitudinal vertical planes with respect to the advance direction. More specifically, between the front bearings (8*a*) there is a larger path than the path of the rear bearings (8*b*). The steps (1*a*, 1*b*) of the escalator are divided among non-movable steps (1*a*), which are associated to the drive chain (2) by the shafts of the front bearings (8*a*) for conventional use and movable vertical steps (1*b*) coupled by means of oscillating arms (9*a*) to an adjacent non-movable step (1*a*) to form a widened platform. In this case the widened platform is constituted by a central non-movable step (1*a*) and a couple of movable steps (1*b*) arranged one at the front and the other behind, said widened platform being configured by the descent of a movable step (1*b*) and the ascent of another movable step (1*b*) so that they are horizontally coplanar. In this case a drive chain (2) is configured by a plurality of arms (9*b*, 9*c*) articulated to the shafts of the front bearings (8*a*) of each non-movable step (1*a*). Each arm (9*b*, 9*c*) is constituted by a couple of partial arms crossed and bound by means of a projecting appendix at the end of one partial arm (9*b*) with a "T" stop housed inside a longitudinal slot of the other partial arm (9*c*) so they can be coupled flexibly as necessary in the transition zones (5*a*, 5*b*). Each partial arm (9*b*, 9*c*) presents, near the articulation of its end with the shaft of the front bearing (8*a*) of a non-movable step (1*a*) of the entire sequence of steps, a vertical articulation (10) that facilitates the mentioned crossing of said partial arms (9*b*, 9*c*).

The advance track (4*a*) comprises a main set of guides (11*a*) and two sets of additional guides (11*b*, 11*c*), one additional set of guides (11*b*) above the set of main guides (11*a*), for the travel path of the movable step (1*b*) of the widened platform that ascends and an additional set of guides (11*c*) under the main set of guides (11*a*), to allow the travel path of the movable step (1*b*) that descends. Each one of said sets of guides (11*a*, 11*b*, 11*c*) is configured by two moving guide couples of the bearings (8*a*, 8*b*), a couple of outer guides for the front bearings (8*a*) and a couple of inner guides for the rear bearings (8*b*). At both ends of the advance track (4*a*) there are sets of points (12) moved by a crank-rod mechanism (13) allowing for the guiding of the movable steps (1*b*) to the corresponding sets of additional guides (11*b*, 11*c*) or from these once the widened platform has been established or disassembled before entering the subsequent transition zone (5*a*, 5*b*).

Each transition zone (5*a*, 5*b*) has sets of guides for the fanned out turning of the steps (1*a*, 1*b*). This set of guides comprises a first guide couple (14*a*) of the front bearings (8*a*) of the steps (1*a*, 1*b*) on an upper plane and a second guide couple (14*b*) of the rear bearings on a lower plane, the different steps (1*a*, 1*b*) being inclined backwards, but without hanging, taking up a smaller space. On both sides of this set of bearing guide couples (14*a*, 14*b*) of the steps (1*a*, 1*b*) there are inner and outer positioning guides (15) with curved alignment of the steps (1*a*, 1*b*) by means of the friction of lateral stops (16) on each step (1*a*, 1*b*).

On each transition zone (5*a*, 5*b*) there is a concealing platform (17) for the transition zones (5*a*, 5*b*) at the entrance and exit of the advance and return tracks (4*a*, 4*b*). These platforms (17) are found on the same level as the surrounding floor for concealment, thus shaping the entrances and exits to the advance and return tracks (4*a*, 4*b*) of the escalator.

The return track (4*b*) also comprises a main set of guides (18*a*) guiding the travel path of the steps (1*a*, 1*b*) in the configuration of a conventional escalator and along which all the steps (1*a*, 1*b*) can circulate, with corresponding sets of additional guides (18*b*, 18*c*) being arranged above and below this set of main guides (18*a*, 18*b*) for the travel path of a movable step (1*b*) upwards and of another movable step (1*b*) downwards, so that they are coplanar with a non-movable step (1*a*) on the main set of guides (18*a*) in order to configure the widened platform. These sets of additional guides (18*b*, 18*c*) and the main set of guides (18*a*) have a common guide couple configuration, thus reducing the number of couples to four, with the two common central couples maintaining the configuration of the tread (6) of each horizontal step when used.

On the escalator section circulating along the advance track (4*a*), the first non-movable step (1*a*) adjacent over the widened platform and the last movable step (1*b*) of said platform have a fixed extended riser to cover the gap formed by the increased height once said platform is formed. On other steps (1*a*, 1*b*) this additional riser (19) can fold down, extending itself by means of a lateral activation of the step (1*a*, 1*b*) involved. Likewise, on the escalator section circulating by the return track (4*b*) the first non-movable step (1*a*) adjacent over the widened platform and the last movable step (1*b*) (these steps do not coincide since the direction of the drive chain is reversed and the visible risers are opposed) also have said additional riser (19) that can fold down and be activated automatically.

The control unit (not represented) operates the drive motor (20) that is associated to the drive chains (2) by means of corresponding chain drum step-down gears (21) that can be attached to the shafts of the front bearings (8*a*) of the steps (1*a*, 1*b*), with a shaft (22) of said drum step-down gears (21) being prolonged on the corresponding movement driving wheels of the handrails (23) of both the advance and return tracks (4*a*, 4*b*).

This control unit is associated with drive means (not represented) at the ends of the tracks (4*a*, 4*b*) or remote controls for the use of the widened platform at the end requested for user access. This control unit is also related to acoustic signals warning (not represented) at said entrances and exits of both tracks.

Once the nature of the invention as well as an example of preferred embodiment have been sufficiently described, it is stated for all pertinent purposes that the materials, form, size and arrangement of the elements described are susceptible to changes, provided this does not involve an alteration of the essential characteristics of the invention that are claimed subsequently. Accordingly, other implementations are within the scope of the following claims.

The invention claimed is:

1. An escalator having an entrance and an exit zone, the escalator comprising:

a series of steps having a tread and at least one riser underneath, wherein at least one of said series of steps is a vertically adjustable step, adjustably positionable to have an upper surface that is substantially coplanar with an upper surface of an adjacent non vertically adjustable step;

an advance track for circulating the steps, the advance track comprising a set of lateral main guides on which the series of steps move by means of front and rear bearings on both sides of said steps, the advance track further comprising at least one set of additional guides for the movement of the at least one vertically-adjustable step, wherein the advance track includes first and second ends;

a return track of the steps; and intermediate transition zones between the advance track and the return track, the intermediate transition zones having a set of transition zone guides, wherein set points are arranged at the first and second ends of the advance track, in correspondence with the entrance and exit zones of the escalator, for the positioning and returning of the movable steps between at least one of the set of transition zone guides, the set of main guides and the at least one set of additional guides.

2. The escalator according to claim 1, wherein the rear and front bearings-are arranged on one plane parallel to an inclined plane of the advance track.

3. The escalator according to claim 1, wherein on the main guides and on the at least one additional guides the rear and front bearings on each side of the steps are arranged in different longitudinal vertical planes with respect to the advance direction.

4. The escalator according to claim 1, wherein the advance track comprises an additional first set of guides above the set of main guides and an additional second set of guides below said main set of guides for the positioning of one or more vertically adjustable steps upwards on one side of the adjacent non-vertically adjustable step and downwards on the other side of the adjacent non-vertically adjustable step.

5. The escalator according to claim 1, wherein the return track is arranged on one side of the advance track thereby creating a transport path that is in an opposite direction to a simultaneous transport path configured by the advance track.

6. The escalator according to claim 5, wherein the transition zone guides between the advance track and the return track define a fanned out turning of the steps, the transition zone guides comprising at least one guide couple of the front bearings of the steps-and a second guide couple of the rear bearings of the steps, and the guide couple of the rear bearings being at a level lower than the guide couple of the front bearings for the positioning of the steps-inclined slightly backwards.

7. The escalator according to claim 1, further comprising:

at least one drive chain with links, wherein the links of the drive chain comprises arms that are attached to shafts of the front bearings of a non-vertically adjustable step.

8. The escalator according to claim 7, further comprising:

oscillating arms for holding the vertically adjustable steps to an adjacent non-vertically adjustable step, the oscillating arms having ends coupled to the shafts of the front bearings of both the vertically adjustable step and the non-vertically adjustable step.

9. The escalator according to claim 5, further comprising:

at least one drive chain with links and arms, wherein the arms are constituted by two partial arms crossed and bound by means of a projecting appendix at the end of a partial arm with a "T" stop housed inside a longitudinal slot of the other partial arm for its coupling of variable length.

10. The escalator according to claim 8, wherein the oscillating arms have, at their opposite ends, vertical articulations for coupling to the shafts of the bearings of the steps.

11. The escalator according to claim 9, wherein the partial arms have, at their opposite ends, vertical articulations for coupling to the shafts of the bearings of the steps.

12. The escalator according to claim 5, wherein the transition zones have one or both of an inner and outer positioning guide of curved alignment of the steps in the turn between the advance and return tracks, and the steps have, on one side, a positioning frictional stop above the positioning guide.

13. The escalator according to claim 1, further comprising:

one or more platforms for concealing the transition zones at the entrance and exit of the advance and return tracks.

14. The escalator according to claim 5, further comprising:

one or more platforms for concealing the transition zones at the entrance and exit of the advance and return tracks.

15. The escalator according to claim 5, wherein the return track comprises a main set of guides for the travel path of the steps and at least one additional set of guides for adjusting the vertically-adjustable steps.

16. The escalator according to claim 15, wherein the sets of main and additional guides of the return track comprise a guide couple for the front bearings of the steps and a guide couple for the rear bearings of the steps, separated by a vertical height corresponding to the difference in distance of the front and rear bearings with respect to the tread of the step in order to position it with said tread on a slightly horizontal upper plane.

17. The escalator according to claim 6, wherein some of the guide couples of the front and rear bearings of the sets of additional guides and some of the guide couples of the front and rear bearings-of the main set of guides-are common.

18. The escalator according to claim 1, wherein adjacent steps of the series of steps define a riser gap therebetween, the escalator further comprising:

a folding riser that activates to completely cover the riser gap between the height of the tread of one step and the height of the tread of an adjacent step.

19. The escalator according to claim 1, wherein the escalator further comprises:

a control unit associated to drive means, the control unit positioned at the ends of the tracks for the positioning of a group of at least one vertically adjustable step and at least one non-vertically adjustable step on one coplanar plane for the entrance and exit of a user.

* * * * *